US010273428B1

(12) United States Patent
Warren

(10) Patent No.: US 10,273,428 B1
(45) Date of Patent: Apr. 30, 2019

(54) LUBRICATING GREASES CONTAINING SOLID LUBRICANT BLENDS

(71) Applicant: Leonard P. Warren, Seymour, TN (US)

(72) Inventor: Leonard P. Warren, Seymour, TN (US)

( * ) Notice: Subject to any disclaimer, the term of this patent is extended or adjusted under 35 U.S.C. 154(b) by 59 days.

(21) Appl. No.: 15/589,193

(22) Filed: May 8, 2017

Related U.S. Application Data

(63) Continuation-in-part of application No. 14/333,718, filed on Jul. 17, 2014, now abandoned, and a continuation-in-part of application No. 13/919,066, filed on Jun. 17, 2013, now abandoned.

(51) Int. Cl.

| | |
|---|---|
| ***C10M 111/04*** | (2006.01) |
| ***C01G 39/06*** | (2006.01) |
| ***C10M 169/06*** | (2006.01) |
| ***C10M 103/06*** | (2006.01) |
| ***C10M 125/22*** | (2006.01) |
| ***C10M 125/20*** | (2006.01) |
| ***C10M 103/02*** | (2006.01) |
| ***C10M 101/02*** | (2006.01) |
| ***C10M 125/18*** | (2006.01) |

(52) U.S. Cl.
CPC ..... *C10M 103/06* (2013.01); *C10M 101/02* (2013.01); *C10M 103/02* (2013.01); *C10M 125/18* (2013.01); *C10M 125/20* (2013.01); *C10M 125/22* (2013.01); *C10M 2201/041* (2013.01); *C10M 2201/0603* (2013.01); *C10M 2201/066* (2013.01); *C10M 2201/081* (2013.01); *C10M 2201/087* (2013.01); *C10M 2203/003* (2013.01); *C10M 2203/024* (2013.01); *C10N 2220/082* (2013.01); *C10N 2230/06* (2013.01); *C10N 2230/08* (2013.01); *C10N 2250/10* (2013.01)

(58) Field of Classification Search
CPC ..... C10M 2211/066; C10M 125/26
USPC ..... 508/155, 167, 168
See application file for complete search history.

(56) References Cited

U.S. PATENT DOCUMENTS

| | | | |
|---|---|---|---|
| 8,222,190 | B2 | 7/2012 | Zhamu et al. |
| 2003/0119681 | A1 | 6/2003 | Patel et al. |

*Primary Examiner* — Prem C Singh
*Assistant Examiner* — Francis C Campanell
(74) *Attorney, Agent, or Firm* — Charles R. Wilson

(57) ABSTRACT

A solid lubricant blend for enhancing lubricity of lubricating greases. The blend comprises a first stage solid lubricant selected from the group consisting of molybdenum disulfide, graphite, polytetrafluorethylene and mixtures thereof, a second stage solid lubricant of boron nitride, a third stage solid lubricant of an inorganic fluoride characterized by being capable of forming a bonded substantially homogeneous film on a substrate at the elevated temperatures and pressures, and graphene. The solid lubricant blend is mixed with a lubricating grease to attain the lubricating grease compositions of the invention.

9 Claims, No Drawings

LUBRICATING GREASES CONTAINING SOLID LUBRICANT BLENDS

This application is a continuation-in-part of prior application Ser. No. 14/333,718, filed Jul. 17, 2014, which is a continuation-in-part of prior application Ser. No. 13/919,066, filed Jun. 17, 2013, now abandoned.

FIELD OF THE INVENTION

This invention relates to a lubricating grease containing a solid lubricant blend. More particularly, the blend comprises a first stage solid lubricant, a second stage lubricant, a third stage solid lubricant, and graphene.

BACKGROUND OF THE INVENTION

Lubricating greases are widely used in industrial and commercial applications. They are used whenever two or more solid surfaces move in close contact. Bearings, suspension joints, gearboxes, and machinery slides are a few of the many used. Any rotating or sliding motion of two solid surfaces working together to accomplish a mechanical purpose uses a lubricating grease.

Some applications require that a lubricating grease be used on an everyday basis, e.g. to repack bearing surfaces. Some applications such as some ball joints have a grease fitting for periodic addition of the grease. Still other applications such as sealed ball joints are considered to be "lubed for life". However, the grease in a sealed ball joint can break down and lose its lubricating characteristic. Care must be taken to ensure the grease used in any part which is sealed be formulated with consideration given to the part's operating use conditions.

Lubricating greases are generally semi-solid in form. A base oil thickened with a thixotropic agent is the major component of such greases. The lubricating greases initially have a high viscosity. After sufficient force is applied, such as encountered by moving gears in a gearbox, the viscosity is reduced. There can be sufficient enough a drop in the viscosity that it approaches that of the base oil.

One base oil is a mineral oil produced by refining crude oil. Mineral oils are most commonly used in lubricating greases. Synthetic oils are commonly used as the base oil for extreme temperature applications. The synthetic oils are produced through chemical synthesis. They typically are polyalphaolefins, esters such as diesters, polyesters, polyolesters, alkylated napthalenes, alkylated benzenes, etc., or hydrocracked/hydroisomerized mineral oils. Semi-synthetic base oils are also available. They are simply blends of mineral oil and synthetic oil.

Thixotropic agents thicken base oils to a semi-solid from. Such agents typically are metallic soaps, metal soaps plus complexing agents and other materials including organo clay, polyurea, silica, carbon black and organic polymers.

It is very common to add one or more performance additives to a lubricating grease depending on the grease's use. Thus, anti-rust agents are added for alleviating corrosion, anti-oxidants to prolong the base oil's life, and others. Enhancing the inherent lubrication effect of the base oil in the lubricating grease is always a desired objective. The better the lubricating property of the base oil, the longer the life of any mechanical device and the more operation efficiency. Each benefit provides a lower cost of operation. The need for enhanced lubrication is particularly noted under heavy work loads that increase the grease's operating temperature and pressure. For example, race cars running at high speeds require greases that effectively operate at temperatures up to about 2100 degrees Fahrenheit and extreme pressures. This temperature is above that which liquid components can operate. Solid lubricants are needed for such temperatures and beyond. Certain industrial equipment with heavy work loads also experience high temperatures and pressures during use that challenge known lubricating greases. Wheeled carts or conveyor belt wheels which carry workpieces through an oven for processing can experience extreme temperatures and force pressures.

In accord with a need, there has been developed a blend of solid components which allows a lubricating grease composition to withstand excessive temperatures and pressures. The blend of components functions effectively in greases at normal operating conditions as well as extreme operating conditions.

SUMMARY OF THE INVENTION

A solid lubricant blend used in lubricating compositions comprises a first stage solid lubricant effective at low temperatures, a second stage solid lubricant effective at low to medium temperatures, a third stage solid lubricant effective at high temperatures and pressures and an effective minuscule amount of graphene. The blends all comprise a first stage solid lubricant selected from the group consisting of molybdenum disulfide, graphite, polytetrafluorethylene and mixtures thereof, a second stage solid lubricant of boron nitride, a third stage solid lubricant of an inorganic fluoride and the graphene.

DETAILED DESCRIPTION OF THE INVENTION

The compositions of the invention comprise a solid lubricant blend which enhances the lubricity of lubricating greases at extreme temperature and pressure use conditions as well as reduces friction, wear and galling. The solid lubricants are readily blended into known lubricating greases. The paragraphs which follow describe in detail the solid lubricants, the solid lubricant blends, and the lubricating grease compositions containing the solid lubricant blends. All percentages stated are on a weight basis.

The lubricant blends comprise three classes of solid lubricants and graphene in specified amounts, which collectively provide lubricity over a wide range of temperatures. It is the unique blend of components interacting with one another which is responsible for the enhanced lubricity of the invention's lubricating grease compositions. The blend comprises a first stage solid lubricant, a second stage solid lubricant, a third stage solid lubricant, and graphene.

The first stage solid lubricant is effective as a lubricant at a low temperature of about −40 degrees Fahrenheit to about 700 degrees Fahrenheit. It is selected from the group consisting of molybdenum disulfide, graphite, polytetrafluorethylene and mixtures thereof. Such materials are generally recognized as having a lubricating characteristic. They are widely used and are commercially available. Particle size of the first stage solid lubricant, as well as the second and third stage solid lubricants, is important for the end user of the compositions. The first stage solid lubricant must have a particle size less than about 40 microns. A preferred particle size is less than about 10 micron while a more preferred size ranges from about 0.25 microns to about 1 micron. Molybdenum disulfide is preferred because of cost, ready availability in proper micron size, high operating temperature capability and overall long term performance. A molybdenum disulfide and graphite mixture in a ratio of about 3:7 to about 7:3 is also preferred for the synergistic lubricity effect the mixture provides.

The second stage solid lubricant is boron nitride. It also is recognized as having a lubricating characteristic and is available commercially. The second stage solid lubricant is effective as a lubricant within a temperature range from about −40 degrees Fahrenheit to about 1500 degrees Fahrenheit. It primarily provides a bridging effect between the first stage solid lubricant and the below discussed third stage solid lubricant. Its particle size is less than about 40 microns. Preferably, the particle size of the boron nitride is less than about 10 microns and more preferably ranges from about 0.5 microns to about 5 microns.

The third stage solid lubricant is an inorganic fluoride characterized as being able to form a substantially homogeneous film on a substrate at elevated temperatures and pressures. Further the homogeneous film can bond to the substrate contacted by the third stage lubricant when at the elevated temperatures and pressures. The elevated temperatures at which the third stage solid lubricant functions as a lubricant is from its softening point to about 2100 degrees Fahrenheit. The softening point is dependent on heat and pressure during use. For uses contemplated, the softening point of the third stage lubricant is about 1400 degrees Fahrenheit. Importantly, it begins to function as a lubricant where the first and second stage lubricants begin to fail. Such extremes are reached by lubricating grease compositions in gearboxes of automobiles, especially high performance race cars and certain industrial machines. The particle size of the third stage solid lubricant is less than about 40 microns. Preferably, it is less than about 10 microns. More preferably, the particle size ranges from about 0.5 microns to about 5 microns.

Inorganic fluorides suitable for use include calcium fluoride, barium fluoride, lithium fluoride, magnesium fluoride, and mixtures thereof. These materials are widely known, though are not regarded as high temperature boundary layer lubricants in the compositions contemplated by this invention. Further, while inorganic fluorides are used as anti-seize agents, the compositions using them are not used where high temperatures and pressures are encountered. Calcium fluoride is preferred because of cost, stability and safety reasons.

It has been found that the lubricating function of the third stage component is created by a combination of heat and pressure. With sufficient pressure, heat is generated, and at a point well below the melting point of the third stage lubricant, it will begin to soften. This soft condition allows the graphene to intermix with it. The two components are then smeared by pressure to create a substantially homogeneous film on the working surfaces of the mechanical device. The film can bond to working surfaces and act as a friction reducer. The film will eventually rub off as it hardens with a drop in friction and heat while still providing boundary layer lubrication. The remaining third stage lubricant then reforms as a film if the extreme temperature and pressure conditions occur again.

Graphene, which is commercially available as two-dimensional carbon nano particles, enhances the lubricating function of the third stage component. A minuscule amount is effective in the lubricating grease compositions of the invention because of its interaction with the third stage high temperature solid lubricant during use as briefly mentioned above and as discussed in more detail in the following paragraph. Anything above the further defined minuscule amount is avoided simply because of cost reasons and the fact no performance benefit is gained. Conventional greases require a greater amount of the graphene to be effective. However, the minuscule graphene level is sufficient in the grease compositions of the invention because (1) inclusion of the inorganic fluoride in the lubricating grease composition, (2) the manner in which inorganic fluoride acts under friction, heat, and pressure, and (3) the contemplated use of the lubricating grease composition. This results in a tremendous economic benefit.

It has been found during use of the lubricating grease compositions where very high levels of friction, heat, and pressure caused by moving parts are experienced that the inorganic fluid softens and forms a film on the moving parts. Graphene particles in circulation adhere to the film's surface and may even overlap forming both single and multi-layer sheets thus forming a matrix that provides extreme durability and lubrication at very high levels of friction, heat and pressure. The graphene then remains attached to the surface of the inorganic fluoride even when some of the matrix is possibly dislodged. The dislodging can occur after hardening due to the temperature dropping with the lowering of friction. The matrix formed then returns to circulation and can be reformed when the situation again warrants it. This also means minimal graphene is needed in the grease compositions. Mainly because at the actual point of moving parts there is a minuscule area of contact in such applications. In fact, no more than a few atoms of graphene is needed to be attached in the matrix since even a single layer sheet formed offers the increased lubrication, friction reduction and wear reduction that graphene provides.

In accord with this invention, a blend of the solid lubricants discussed above is mixed with a lubricating grease in the proportions discussed below. The solid lubricants can be preblended and added to the lubricating grease or added one at a time if desired. As evident, formulators of the grease compositions of the invention have wide latitude in how the solid lubricants are incorporated into a formulation.

The above described three solid lubricant classes and graphene are blended together in proportions dependent in large part by the end use contemplated for any resultant lubricating grease composition. A blend which is formulated prior to addition to the lubricating grease which is most useful comprises from about 10% to about 40% of the first stage solid lubricant, from about 10% to about 30% of the second stage solid lubricant, from about 40% to about 80% of the third stage solid lubricant and less than about 0.0150% of the graphene. Preferably, a blend from above of 15% to about 35% of the first stage solid lubricant, from about 15% to about 20% of the second stage solid lubricant and from about 45% to about 70% of the third stage solid lubricant, and from about 0.0060% to about 0.0150% graphene is made in advance for addition to the lubricating greases.

The ready to use solid lubricant blend of the invention is useful with most lubricating greases currently used, but is of most use in a high performance environment where lubricity at extreme temperatures and pressure conditions are likely to be encountered. The lubricating grease compositions of the invention comprise from about 1% to about 25%, preferably about 2% to about 10% of the first stage solid lubricant, from about 0.5% to about 12%, preferably about 1% to about 6% of the second stage solid lubricant, from about 4% to about 35%, preferably about 10% to about 30% of the third stage solid lubricant, an effective amount up to about 0.0008%, preferably about 0.0003% to about 0.0008% of the graphene, and the balance a thickened base oil, commonly referred to as a lubricating grease. Preferably, the thickened base oil represents about 50% to about 80% of the compositions. Base oils and thickeners are described in detail below.

Base oils typically are defined as an oil with a boiling point between 550 and 1060 degrees Fahrenheit and having from 18 to 40 carbon atoms. They are either a mineral oil, a synthetic oil or a mixture thereof. Such oils are widely used. Mineral base oils are derived from crude oil that has been refined to remove unwanted fractions such as gasoline, waxes, etc. Synthetic base oils are made by chemical processes that are chemically designed to give products with properties not found in the mineral base oils, e.g. heat resistance. Base oils useful in the compositions are found in U.S. Pat. No. 8,354,566, Col. 13, line 32 to Col. 15, line 37, the disclosure of which is hereby incorporated by reference. In particular, examples of mineral oils are given in Col. 13, lines 62-67. Examples of synthetic oils are given in Col. 14, line 1 to Col. 15, line 6.

There are several known thickeners which are used with the base oil in the lubricating grease compositions of the invention. They can be a metallic soap such as calcium stearate, sodium stearate, lithium stearate and mixtures thereof. Fatty acid derivatives, other than stearates are also used such as lithium 12-hydroxystearate. Metallic soap plus complexity agent are as well used. Examples include calcium complex, lithium complex, and aluminum complex. Other commonly used thickeners are organon clays, mica, graphite, silica, carbon black, polyurea, and organic polymers.

Any of several known additives commonly added to lubricating greases which are compatible with the solid lubricants of the invention are used. Such additives include friction modifiers, anti-wear agents, antioxidants, viscosity index improvers, rust inhibitors, and metal deactivating agents. The additives are used in functionally effective amounts to get the desired benefit.

The examples which follow are representative formulations of solid lubricant blends and lubricating grease compositions. Examples 1-3 illustrate the lubricant blends while Examples 4-6 illustrate the lubricating grease compositions.

EXAMPLE 1

This example illustrates a solid lubricant blend.

| Component | Wt. % | Particle Size (microns) |
|---|---|---|
| Molybdenum Disulfide (Moly) | 37.6940 | <1 |
| Boron Nitride | 18.8500 | ≤4 |
| Calcium Flouride | 43.4500 | ≤4 |
| Graphene | 0.0060 | |
| | 100.0000% | |

EXAMPLE 2

A solid lubricant blend is illustrated.

| Component | Wt. % | Particle Size (microns) |
|---|---|---|
| Molybdenum Disulfide | 12.5000 | <1 |
| Boron Nitride | 12.5000 | ≤4 |
| Calcium Flouride | 74.9930 | ≤4 |
| Graphene | 0.0070 | |
| | 100.0000% | |

EXAMPLE 3

Still another solid lubricant blend of the invention is now illustrated.

| Component | Wt. % | Particle Size (microns) |
|---|---|---|
| Molybdenum Disulfide | 24.3400 | <1 |
| Boron Nitride | 12.1700 | ≤10 |
| Calcium Flouride | 63.4750 | ≤20 |
| Graphene | 0.0150 | |
| | 100.0000% | |

EXAMPLE 4

This example illustrates a multi-use lubricating grease composition containing a blend of the first, second, and third stage solid lubricants of the invention.

| Component | Wt. % | Particle Size (microns) |
|---|---|---|
| Molybdenum Disulfide | 10.1300 | <1 |
| Boron Nitride | 5.0700 | ≤4 |
| Calcium Flouride | 11.6700 | ≤4 |
| Graphene | 0.0007 | |
| Group III Semi-Synthetic Base Oil With Thickener | 73.1293 | |
| | 100.0000% | |

EXAMPLE 5

A lubricating grease composition with the solid lubricant blend of Example 1 is illustrated in this example. It is used where frequent lubrication is required.

| Component | Wt. % | Particle Size (microns) |
|---|---|---|
| Molybdenum Disulfide | 1.5000 | <10 |
| Boron Nitride | 1.0000 | ≤20 |
| Calcium Flouride | 4.0000 | ≤20 |
| Graphene | 0.0003 | |
| Antioxidant (1) | 0.5000 | |
| Friction Modifier (2) | 0.1400 | |
| Viscosity Index Improver (3) | 6.4000 | |
| Group III Mineral Base Oil With Thickener | 86.4597 | |
| | 100.0000% | |

(1) Available from Ciba Specialty Chemicals as IRGANOX L64
(2) Available from Chemtura Corp. as NAUGALUBE 810
(3) Available from Infinies as SV205

The composition is formulated by first blending the three solid lubricants together and then blending the resultant mixture with the thickened mineral base oil grease.

EXAMPLE 6

The following lubricating grease composition is still another example of the lubricating grease composition of the invention. It is most useful in a one-time lubrication system such as a sealed bearing.

| Component | Wt. % | Particle Size (microns) |
|---|---|---|
| Molybdenum Disulfide | 10.0000 | <1 |
| Boron Nitride | 6.0000 | ≤4 |
| Calcium Flouride | 30.0000 | ≤4 |
| Graphene | 0.0007 | |
| Antioxidant | 0.5000 | |
| Friction Modifier | 0.1400 | |
| Viscosity Modifier | 1.4000 | |
| Group III Synthetic Base Oil With Thickener | 51.9525 | |
| | 100.0000% | |

The dispersant, antioxidant, friction modifier, and viscosity modifier are the same as described in Example 5.

Having described the invention in its preferred embodiment, it should be clear that modifications can be made without departing from the spirit of the invention. It is not intended that the words used to describe the invention be limiting on the invention. It is intended that the invention only be limited by the scope of the appended claims.

I claim:

1. A lubricating grease composition intended for use where extreme use conditions are encountered consisting essentially of:

(a) from about 1% to about 25% of a first stage solid lubricant effective at low temperatures of about −40 degrees Fahrenheit to about 700 degrees Fahrenheit, wherein said first stage solid lubricant is molybdenum disulfide;

(b) from about 0.5% to about 12% of a second stage medium temperature solid lubricant effective at medium temperatures of about −40 degrees Fahrenheit to about 1500 degrees Fahrenheit, wherein said second stage solid lubricant is boron nitride;

(c) from about 4% to about 35% of a third stage high temperature solid lubricant effective at high temperatures up to about 2100 degrees Fahrenheit, wherein said third stage solid lubricant is an inorganic fluoride characterized by being capable of forming a bondable substantially homogeneous film on a solid substrate at elevated temperatures and pressures and is selected from the group consisting of calcium fluoride, barium fluoride, lithium fluoride, magnesium fluoride, and mixtures thereof;

(d) from about 0.0003% to about 0.0008% of graphene to enhance the lubricity of the inorganic fluoride by forming a single or multi-layer sheet of graphene onto a formed film of the inorganic fluoride during use; and (e) the balance a thickened base oil.

2. The lubricating grease composition of claim 1 wherein the first stage solid lubricant has a particle size less than about 40 microns, the second stage solid lubricant has a particle size less than about 40 microns and the third stage solid lubricant has a particle size of less than about 40 microns.

3. The lubricating grease composition of claim 2 wherein the first stage solid lubricant has a particle size less than about 10 microns, the second stage solid lubricant has a particle size less than about 10 microns and the third stage solid lubricant has a particle size less than about 10 microns.

4. The lubricating grease composition of claim 3 wherein the first stage solid lubricant has a particle size of from about 0.25 microns to about 1 micron, the second stage solid lubricant has a particle size of about 0.5 microns to about 5 microns and the third stage solid lubricant has a particle size of from about 0.5 microns to about 5 microns.

5. The lubricating grease composition of claim 4 wherein the third stage solid lubricant is calcium fluoride.

6. The lubricating grease composition of 5 comprising from about 2% to about 10% of the first stage lubricant, about 1% to about 6% of the second stage lubricant, from about 10% to about 30% of the third stage lubricant, from about 0.0003% to about 0.0008% of the graphene and from about 50% to about 80% of the thickened base oil.

7. The lubricating grease composition of claim 6 wherein the thickened base oil is a thickened mineral oil.

8. The lubricating grease composition of claim 6 wherein the thickened base oil is a thickened synthetic oil.

9. A lubricating grease composition consisting essentially of:

(a) from about 2% to about 10% of a first stage solid lubricant effective at low temperatures of about −40 degrees Fahrenheit to about 700 degrees Fahrenheit and having a particle size less than about 10 microns, wherein said first stage solid lubricant is molybdenum disulfide;

(b) from about 1% to about 6% of a second stage medium temperature solid lubricant effective at medium temperatures of about −40 degrees Fahrenheit to about 1500 degrees Fahrenheit and having a particle size less than about 10 microns, wherein said second stage solid lubricant is boron nitride;

(c) from about 10% to about 30% of a third stage high temperature solid lubricant effective at high temperatures up to about 2100 degrees Fahrenheit and having a particle size less than about 10 microns, wherein said third stage solid lubricant is calcium fluoride;

(d) from about 0.0003% to about 0.0008% of graphene to enhance the lubricity of the inorganic fluoride by forming a single or multi-layer sheet of graphene onto a formed film of the calcium fluoride during use; and (d) the balance a thickened base oil.

* * * * *